US012516831B1

(12) United States Patent
Li

(10) Patent No.: US 12,516,831 B1
(45) Date of Patent: Jan. 6, 2026

(54) ROTARY DRIPPING AROMATHERAPY HUMIDIFIER

(71) Applicant: Chunsheng Li, Ganzhou (CN)

(72) Inventor: Changchun Li, Ganzhou (CN)

( * ) Notice: Subject to any disclaimer, the term of this patent is extended or adjusted under 35 U.S.C. 154(b) by 0 days.

(21) Appl. No.: 19/324,182

(22) Filed: Sep. 10, 2025

Related U.S. Application Data

(63) Continuation of application No. PCT/CN2024/088538, filed on Apr. 18, 2024.

(30) Foreign Application Priority Data

Jun. 3, 2023 (CN) ..... 202321396877.8

(51) Int. Cl.
*F24F 6/12* (2006.01)
*F24F 6/00* (2006.01)

(52) U.S. Cl.
CPC ..... *F24F 6/12* (2013.01); *F24F 2006/008* (2013.01); *F24F 2221/02* (2013.01)

(58) Field of Classification Search
CPC ..... F24F 6/12; F24F 2006/008; F24F 2221/02
USPC ..... 261/81, 83, DIG. 88
See application file for complete search history.

(56) References Cited

U.S. PATENT DOCUMENTS 5,693,266 A * 12/1997 Jung ..... B01F 23/2133 261/80
10,054,323 B2 * 8/2018 Son ..... F24F 13/28
11,835,256 B1 * 12/2023 Li ..... F24F 6/00
12,161,783 B1 * 12/2024 Fang ..... F24F 6/16
2024/0240814 A1 * 7/2024 Li ..... A61L 9/14

FOREIGN PATENT DOCUMENTS

| | | | |
|---|---|---|---|
| CN | 108679765 A | | 10/2018 |
| CN | 212274178 U | | 1/2021 |
| CN | 212842003 U | | 3/2021 |
| CN | 216346807 U | | 4/2022 |
| CN | 216592054 U | | 5/2022 |
| CN | 216977043 U | | 7/2022 |
| CN | 220205958 U | | 12/2023 |
| JP | 2005274041 A | * | 10/2005 |

OTHER PUBLICATIONS

English Machine Translation of JP 2005274041A (Year: 2005).*
ISR of PCT/CN2024/088538, Aug. 2024.

* cited by examiner

*Primary Examiner* — Charles S Bushey

(57) ABSTRACT

A rotary dripping aromatherapy humidifier is provided, including a humidifier host body, a water storage cover located on an upper part of the humidifier host body, and a support guide tube configured to support the water storage cover. Fog and mist generated by an atomization assembly get into the water storage cover after passing through the support guide tube, and drip downwards from the part of the dripping holes. The bottom of the support guide tube stretches into an inner side of the humidifier host body. The rotary dripping aromatherapy humidifier further includes a drive motor configured to drive the support guide tube to rotate axially.

10 Claims, 7 Drawing Sheets

ROTARY DRIPPING AROMATHERAPY HUMIDIFIER

TECHNICAL FIELD

The present disclosure relates to the field of humidifier product technologies, in particular to a rotary dripping aromatherapy humidifier with outstanding application effects.

BACKGROUND

Aromatherapy humidifier products are common products in people's daily lives. The products are different in shapes and sizes, and give consumers more choices. Particularly, in recent years, a structure feature of a combination of atomized fog components and light components, a top dripping structure with a dripping effect, and the like are used, so that the using experience of the aromatherapy humidifier product is greatly improved.

If an aromatherapy diffuser with a raindrop effect is specifically disclosed in a patent for an invention with the application number of CN202310080449.2 and the patent name of AROMATHERAPY DIFFUSER WITH RAINDROP EFFECT. The aromatherapy diffuser includes a bottom shell, a water tank disposed in the bottom shell, and an atomization module disposed on the water tank. A cloud-shaped housing is disposed above the water tank. The water tank is provided with a water pump module configured to extract liquid inside the water tank into the cloud-shaped housing. A drain hole is disposed at a lower end of the cloud-shaped housing. A light source that may emit different colors is disposed inside the cloud-shaped housing. During operation, water in the water tank is extracted from the cloud-shaped housing by the water pump module. Water in the cloud-shaped housing is discharged from the drain hole, and raindrops are formed into the water tank. Then, water extracted into the cloud-shaped housing by the water pump module to form a cycle, so as to imitate a scenario that raindrops are formed by cloud raining. In addition, the light source in the cloud-shaped housing may emit light of different colors, so as to imitate a scenario in which a cloud changes colors, and fog generated by the atomization module moves upward to a lower end or a periphery of the cloud-shaped housing, so as to form a rainbow simulation effect under the effect of light.

The foregoing aroma diffuser product pumps water to a high level by using the water pump, and then the water drips down to finally implement a rainbow-like atomization effect. However, a structure of a product in the foregoing prior art has a water pump module, which not only increases product costs but also is not conducive to maintenance. In addition, a function experience of dripping is normal, and a spray effect cannot be implemented, so that functionality is poor.

Based on this, it is a problem considered by a person skilled in the art to use a structure that reduces product costs, does not affect use experience, and improves product function diversity.

SUMMARY

Problems that are solved by this application and that exists in the prior art are as follows:

The aroma diffuser product in the prior art generally pumps water to a high level by using the water pump, and then the water drips down to finally implement a rainbow-like atomization effect. However, a structure of a product in the foregoing prior art has a water pump module, which not only increases product costs but also is not conducive to maintenance. In addition, a function experience of dripping is normal, and a spray effect cannot be implemented, so that functionality is poor.

A solution of solving the technical problem by the present disclosure is as follows:

A rotary dripping aromatherapy humidifier is provided, including a humidifier host body, a water storage cover located at an upper part of the humidifier host body, and a support guide tube configured to support the water storage cover; a control circuit board and an atomization assembly are disposed inside the humidifier host body; the rotary dripping aromatherapy humidifier further includes dripping holes provided on the water storage cover;

the support guide tube is of an internally hollow structure, and the atomization assembly is located at the bottom of the support guide tube; fog and mist generated by the atomization assembly get into the water storage cover after passing through the support guide tube, and drip downwards from the part of the dripping holes;

a water storage tank configured to store water is disposed in the humidifier host body; water dripping from the dripping holes flows into the water storage tank;

the bottom of the support guide tube stretches into an inner side of the humidifier host body; the rotary dripping aromatherapy humidifier further includes a drive motor configured to drive the support guide tube to rotate axially; an output shaft of the drive motor is in drive movable connection with a lower part of the support guide tube, so as to drive the support guide tube to rotate axially together with the water storage cover; and the atomization assembly and the drive motor are electrically connected to the control circuit board.

Preferably, a gear sleeve connector in matched connection with the bottom of the support guide tube is further disposed in the humidifier host body; a drive gear is disposed on an outer edge of the gear sleeve connector;

the output shaft of the drive motor is connected to a driving gear; the drive motor and the gear sleeve connector are gear-driven; and a rotating column, a rotating boss, or a rotating slot configured to limit the gear sleeve connector is further disposed on the inner side of the humidifier host body.

Preferably, at least one rolling bearing is further disposed on the inner side of the gear sleeve connector; the rolling bearing is located at a part between the gear sleeve connector and the rotating column or the rotating boss; and a bearing stopper configured to define a position of the rolling bearing is disposed on the inner side of the gear sleeve connector.

Preferably, a first running fit surface is disposed around the inner side of the gear sleeve connector; a second running fit surface corresponding to the first running fit surface is disposed on the outer side of the rotating column or the rotating boss; and the gear sleeve connector and the rotating column or the rotating boss are rotatably connected by using the first running fit surface and the second running fit surface.

Preferably, at least one water tray to play water storage, dripping, and decoration functions is further disposed on the support guide tube;

water tray water storage slots corresponding to the dripping holes are provided on the water tray; water tray dripping holes are provided in the water tray water storage slot; and water from the dripping holes drips into the water tray water storage slots, and drips into the water storage tank by using the water tray dripping holes.

Preferably, the humidifier host body includes an outer housing;

the water storage tank is located at an upper part of the outer housing;

the control circuit board, the atomization assembly, and the drive motor are located in internal space between the bottom of the water storage tank and the outer housing; and an upper end of the output shaft of the drive motor stretches into the bottom of the water storage tank.

Preferably, the water storage cover includes a water storage box configured to store water and a top cover in matched connection with an upper part of the water storage box; the dripping holes are provided in the water storage box;

the top of the support guide tube is in matched connection with the water storage box, so as to input fog and mist into the water storage cover; and the rotary dripping aromatherapy humidifier further includes spray holes provided on the top cover.

Preferably, an atomization concentrating cylinder configured to increase a water spray height of the atomization assembly is further disposed on the inner side of the rotating column or the rotating boss;

the atomization concentrating cylinder and the inner side of the humidifier host body are connected or integrally formed;

the atomization concentrating cylinder is located at an upper part of the atomization assembly; and a water inlet hole for supplying water to the part of the atomization concentrating cylinder is provided on the rotating column or the rotating boss.

Preferably, an air inlet hole is further provided on the support guide tube, so as to facilitate air to enter into the inner side of the support guide tube.

Preferably, LED (Light-Emitting Diode) light beads are further disposed inside the humidifier host body, so as to produce a lighting effect.

Technical effects generated for solving the technical problem according to the present disclosure are as follows:

Compared with the prior art, a rotary dripping aromatherapy humidifier in the present disclosure is provided with a humidifier host body, a water storage cover 19 located on an upper part of the humidifier host body, and a support guide tube 17 configured to support the water storage cover 19 at the same time. The control circuit board 111 and the atomization assembly 12 are disposed inside the humidifier host body. The rotary dripping aromatherapy humidifier further includes dripping holes 194 provided on the water storage cover 19. The support guide tube 17 is of an internally hollow structure, and the atomization assembly 12 is located at the bottom of the support guide tube 17. Fog and mist generated by the atomization assembly 12 get into the water storage cover 19 after passing through the support guide tube 17, and drip downwards from the part of the dripping holes 194. The water storage tank 14 configured to store water is disposed in the humidifier host body. The water dripping from the dripping holes 194 flows into the water storage tank 14. The bottom of the support guide tube 17 stretches into the inner side of the humidifier host body. The rotary dripping aromatherapy humidifier further includes a drive motor 13 configured to drive the support guide tube 17 to rotate axially. An output shaft of the drive motor 13 is in drive movable connection with a lower part of the support guide tube 17, so as to drive the support guide tube 17 to rotate axially together with the water storage cover 19. During actual use, the drive motor 13 can drive the support guide tube 17 and the water storage cover 19 to rotate axially integrally, and effects such as water dripping, lamplight, and mist spraying are combined, thereby greatly improving using ornamental degree and experience degree in use and saving costs.

Figure 1:
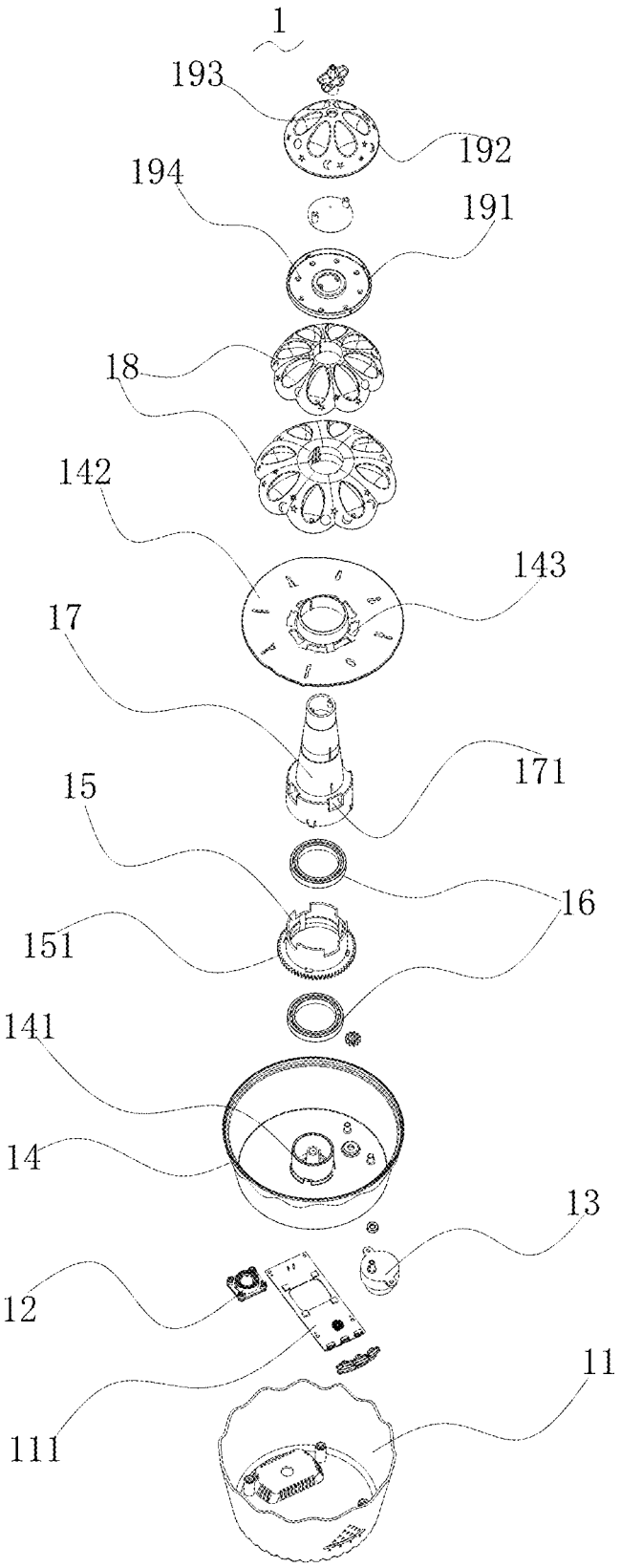
FIG. 1 and FIG. 2 are structural diagrams of a rotary dripping aromatherapy humidifier in an explosion state according to a first embodiment of the present disclosure.
Figure 2:
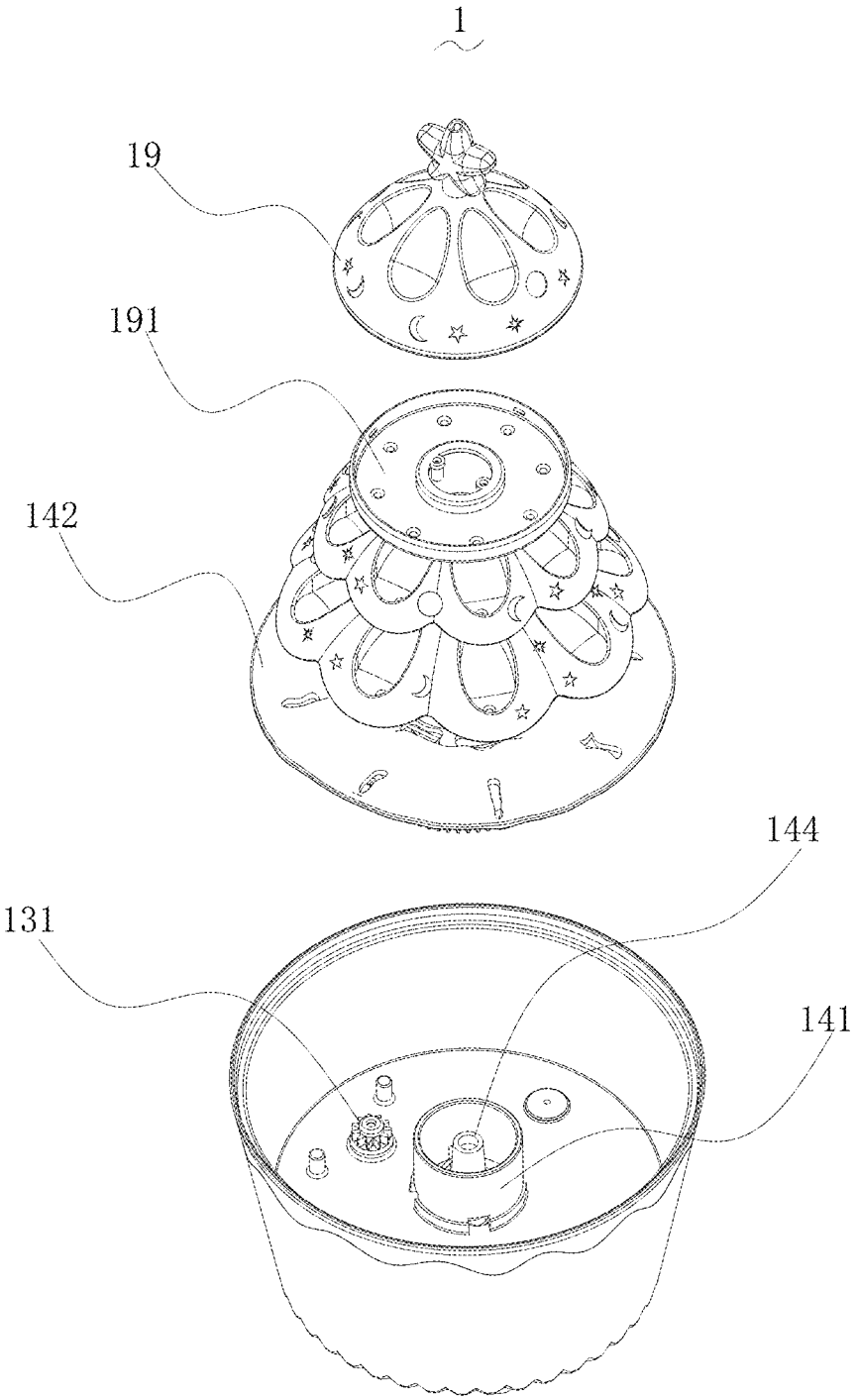
Figure 3:
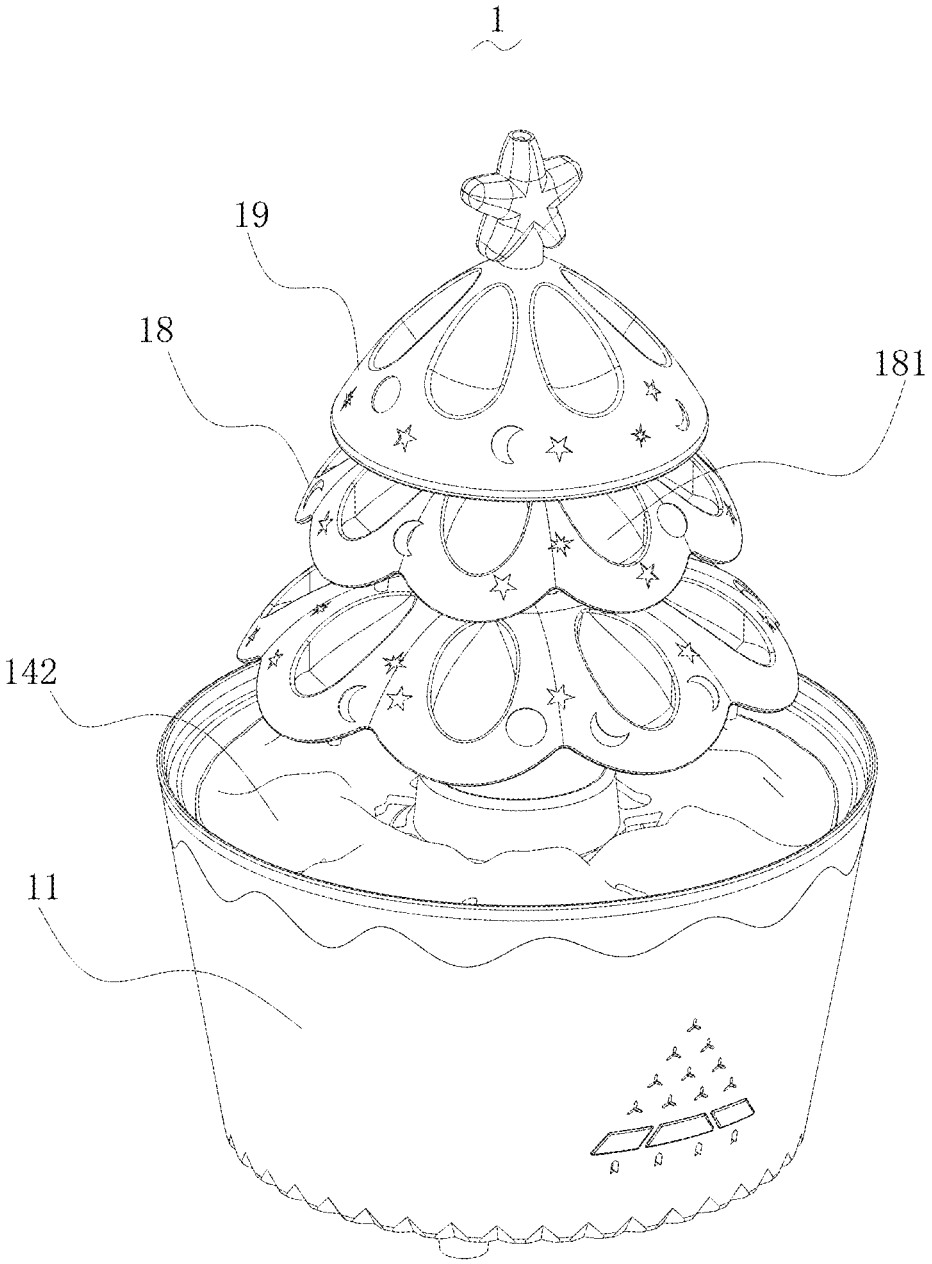
FIG. 3 is a structural diagram of a rotary dripping aromatherapy humidifier in a three-dimensional state according to a first embodiment of the present disclosure.
Figure 4:
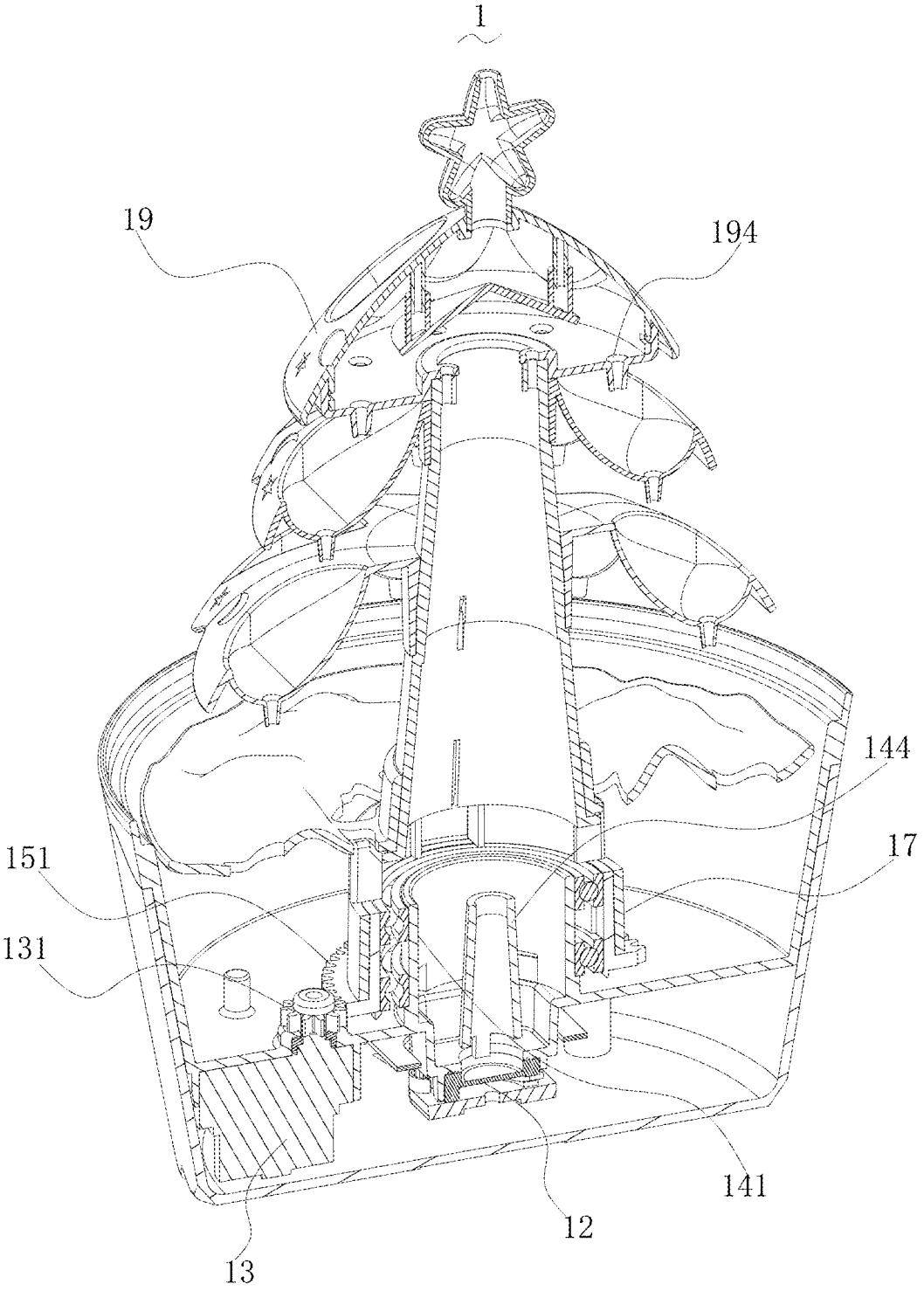
FIG. 4 is a structural diagram of a rotary dripping aromatherapy humidifier in a sectional state according to a first embodiment of the present disclosure.
Figure 5:
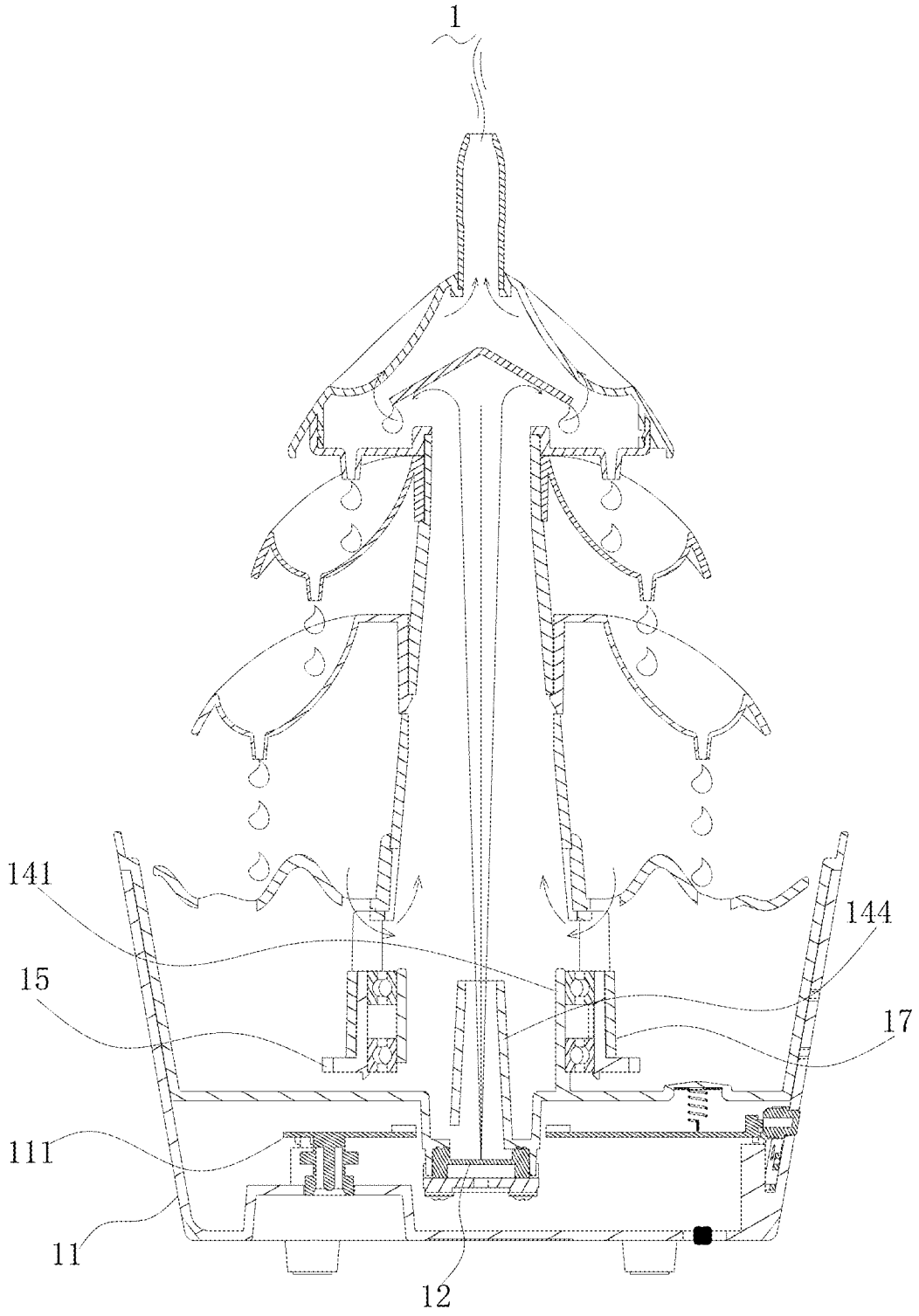
FIG. 5 is a structural diagram of a rotary dripping aromatherapy humidifier in a sectional state according to a first embodiment of the present disclosure.

Reference numerals: 11: outer housing; 111: control circuit board; 12: atomization assembly; 13: drive motor; 131: driving gear; 14: water storage tank; 141: rotating column; 142: modeling cover; 143: water inlet through hole or ventilation hole; 144: atomization concentrating cylinder; 15: gear sleeve connector; 151: drive gear; 16: rolling bearing; 17: support guide tube; 18: water tray; 181: water tray water storage slot: 19: water storage cover; 191: water storage box; 192: top cover; 193: spray hole; 194: dripping hole; 241: rotating column; 25: gear sleeve connector; and 251: first running fit surface.

DETAILED DESCRIPTION OF THE EMBODIMENTS

In order to make the objectives, technical solutions and advantages of the present disclosure clearer, the present disclosure will be further described hereinbelow with reference to the drawings and embodiments thereof. It shall be understood that, specific embodiments described herein are only intended to illustrate but not to limit the present disclosure.

Referring to FIG. 1 to FIG. 5, a rotary dripping aromatherapy humidifier 1 according to a first embodiment of the present disclosure includes a humidifier host body, a water storage cover 19 located at an upper part of the humidifier host body, and a support guide tube 17 configured to support the water storage cover 19. A control circuit board 111 and an atomization assembly 12 are disposed inside the humidifier host body. The rotary dripping aromatherapy humidifier 1 further includes dripping holes 194 provided on the water storage cover 19.

The support guide tube 17 is of an internally hollow structure, and the atomization assembly 12 is located at the bottom of the support guide tube 17. Fog and mist generated by the atomization assembly 12 get into the water storage cover 19 after passing through the support guide tube 17, and drip downwards from the part of the dripping holes 194.

A water storage tank 14 configured to store water is disposed in the humidifier host body. Water dripping from the dripping holes 194 flows into the water storage tank 14.

The bottom of the support guide tube 17 stretches into an inner side of the humidifier host body. The rotary dripping aromatherapy humidifier further includes a drive motor 13 configured to drive the support guide tube 17 to rotate axially. An output shaft of the drive motor 13 is in drive movable connection with a lower part of the support guide tube 17, so as to drive the support guide tube 17 to rotate axially together with the water storage cover 19.

The drive movable connection includes a direct drive connection between the output shaft of the drive motor 13 and the support guide tube 17, or a drive connection to the support guide tube 17 by using one or more drive connectors in the middle. The connections are both within the protection scope of this application.

The atomization assembly 12 and the drive motor 13 are electrically connected to the control circuit board 111.

In this application, a rotary dripping aromatherapy humidifier is provided with a humidifier host body, a water storage cover 19 located on an upper part of the humidifier host body, and a support guide tube 17 configured to support the water storage cover 19 at the same time. The control circuit board 111 and the atomization assembly 12 are disposed inside the humidifier host body. The rotary dripping aromatherapy humidifier further includes dripping holes 194 provided on the water storage cover 19. The support guide tube 17 is of an internally hollow structure, and the atomization assembly 12 is located at the bottom of the support guide tube 17. Fog and mist generated by the atomization assembly 12 get into the water storage cover 19 after passing through the support guide tube 17, and drip downwards from the part of the dripping holes 194. The water storage tank 14 configured to store water is disposed in the humidifier host body. The water dripping from the dripping holes 194 flows into the water storage tank 14. The bottom of the support guide tube 17 stretches into the inner side of the humidifier host body. The rotary dripping aromatherapy humidifier further includes a drive motor 13 configured to drive the support guide tube 17 to rotate axially. An output shaft of the drive motor 13 is in drive movable connection with a lower part of the support guide tube 17, so as to drive the support guide tube 17 to rotate axially together with the water storage cover 19. During actual use, the drive motor 13 can drive the support guide tube 17 and the water storage cover 19 to rotate axially integrally, and effects such as water dripping, lamplight, and mist spraying are combined, thereby greatly improving using ornamental degree and experience degree in use and saving costs.

In some other embodiments, a gear sleeve connector 15 in matched connection with the bottom of the support guide tube 17 is further disposed in the humidifier host body; a drive gear 151 is disposed on an outer edge of the gear sleeve connector 15;

the output shaft of the drive motor 13 is connected to a driving gear 131; the drive motor 13 and the gear sleeve connector 15 are gear-driven; and a rotating column 141, a rotating boss, or a rotating slot configured to limit the gear sleeve connector 15 is further disposed on the inner side of the humidifier host body.

Preferably, at least one rolling bearing 16 is further disposed on the inner side of the gear sleeve connector 15; the rolling bearing 16 is located at a part between the gear sleeve connector 15 and the rotating column 141 or the rotating boss; and a bearing stopper configured to define a position of the rolling bearing 16 is disposed on the inner side of the gear sleeve connector 15.

At least one water tray 18 to play water storage, dripping, and decoration functions is further disposed on the support guide tube 17;

water tray water storage slots 181 corresponding to the dripping holes 194 are provided on the water tray 18; water tray dripping holes are provided in the water tray water storage slot 181; and water from the dripping holes 194 drips into the water tray water storage slots 181, and drips into the water storage tank 14 by using the water tray dripping holes.

A design of the plurality of water trays 18 enables the humidifier product to be in a Christmas tree shape as a whole, and use experience is higher.

The support guide tube 17 and the water tray 18 may be fastened and connected by using a buckle structure. The support guide tube 17 runs through the water tray 18, and is fastened and connected to the water tray 18 at a penetrating part. A connecting structure similar to the buckle structure belongs to an equivalent technical solution.

The humidifier host body includes an outer housing 11;

the water storage tank 14 is located at an upper part of the outer housing 11;

the control circuit board 111, the atomization assembly 12, and the drive motor 13 are located in internal space between the bottom of the water storage tank 14 and the outer housing 11; and an upper end of the output shaft of the drive motor 13 stretches into the bottom of the water storage tank 14.

The water storage cover 19 includes a water storage box 191 configured to store water and a top cover 192 in matched connection with an upper part of the water storage box 191; the dripping holes 194 are provided in the water storage box 191;

the top of the support guide tube 17 is in matched connection with the water storage box 191, so as to input fog and mist into the water storage cover 19; and the rotary dripping aromatherapy humidifier further includes spray holes 193 provided on the top cover 192.

Or a decorating part is disposed on an upper part of the top cover 192, and the spray hole 193 is disposed on the decorating part;

an atomization concentrating cylinder 144 configured to increase a water spray height of the atomization assembly 12 is further disposed on the inner side of the rotating column 141 or the rotating boss;

the atomization concentrating cylinder 144 and the inner side of the humidifier host body are connected or integrally formed;

the atomization concentrating cylinder 144 is located at an upper part of the atomization assembly 12; and a water inlet hole for supplying water to the part of the atomization concentrating cylinder 144 is provided on the rotating column 141 or the rotating boss.

Generally, an atomization water storage slot is disposed in a lower part of the atomization concentrating cylinder 144, and the atomization assembly 12 is located at the bottom of the atomization water storage slot; water flows into the atomization water storage slot from the part of the water inlet hole; and an air inlet hole 171 is further provided on the support guide tube 17, so as to facilitate air to enter into the inner side of the support guide tube 17.

In some other embodiments, a modeling cover 142 may be further disposed on an upper part of the humidifier host body; a water inlet through hole and/or ventilation hole 143 configured to recycle water droplets is disposed on the modeling cover 142, so as to implement ventilation and communication with the support guide tube 17; and LED (Light-Emitting Diode) light beads are further disposed inside the humidifier host body, so as to produce a lighting effect.

Figure 6:
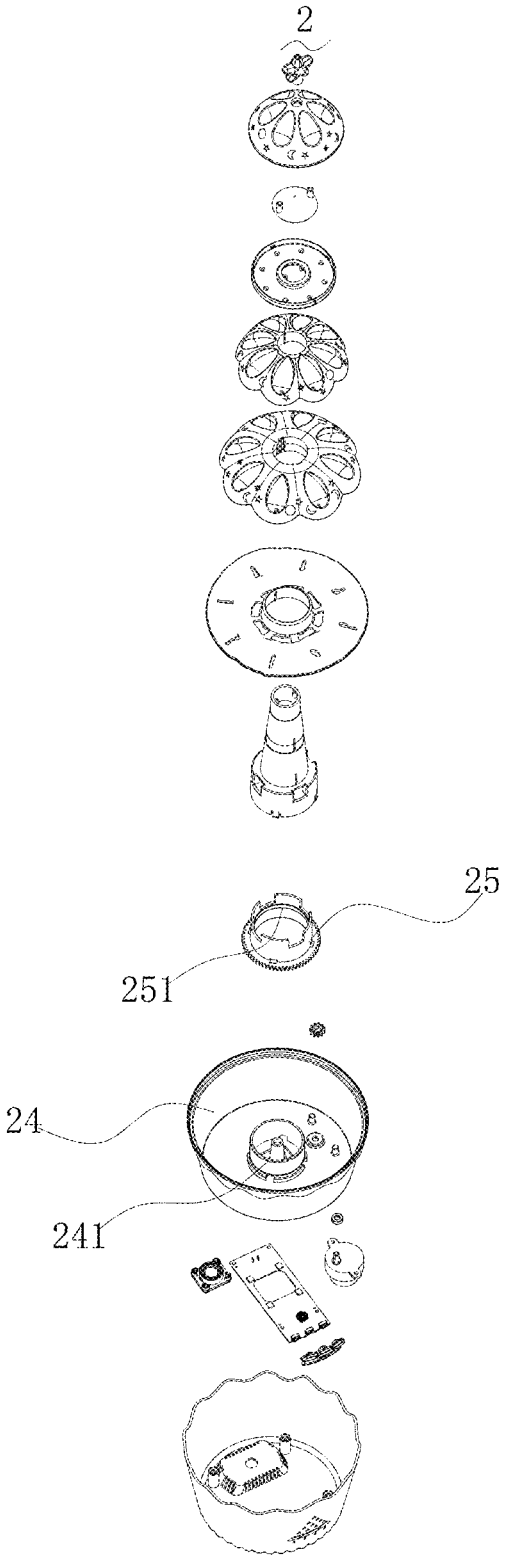
FIG. 6 is a structural diagram of a rotary dripping aromatherapy humidifier in an explosion state according to a second embodiment of the present disclosure.
Figure 7:
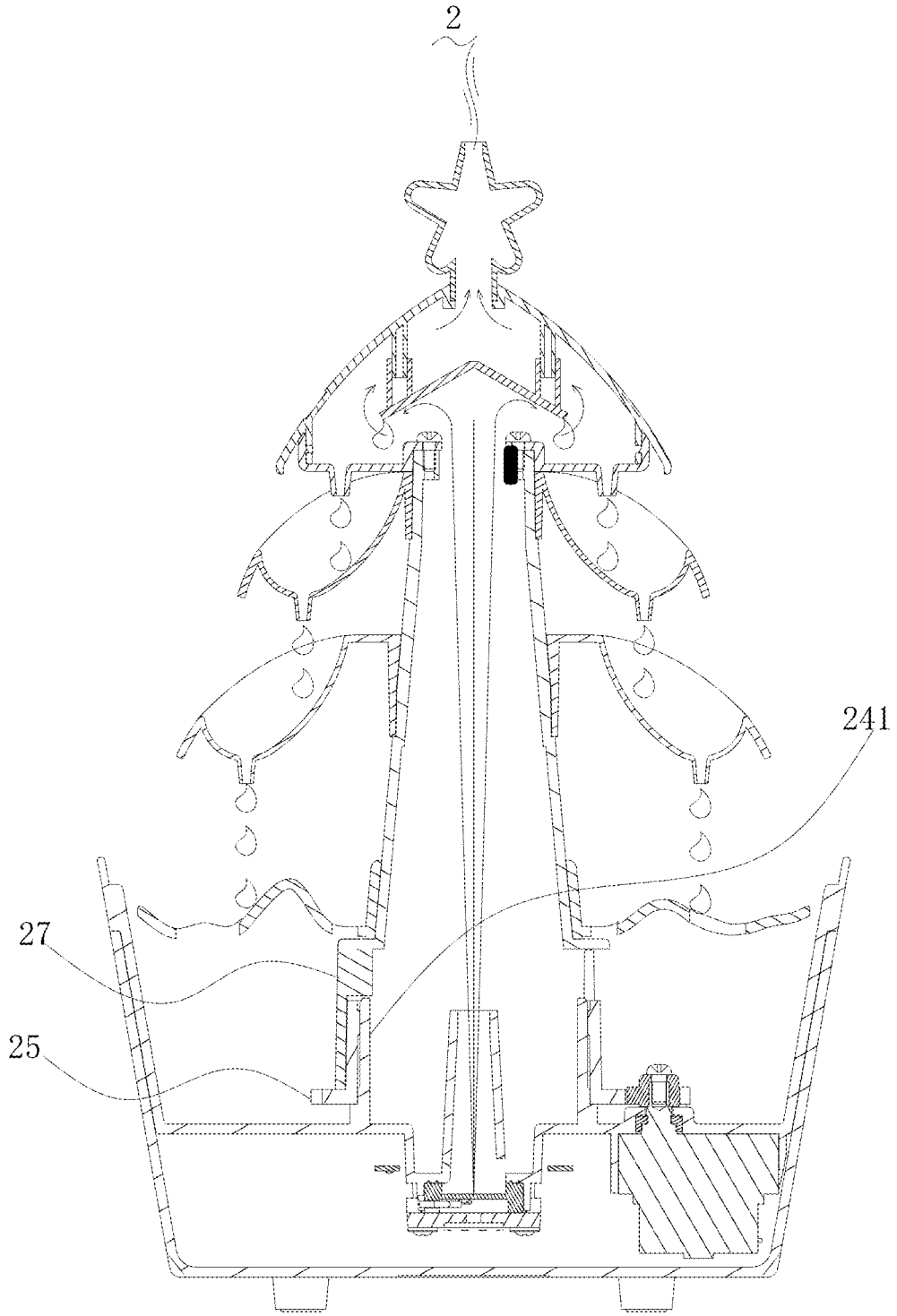
FIG. 7 is a structural diagram of a rotary dripping aromatherapy humidifier in a sectional state according to a second embodiment of the present disclosure.

Referring to FIG. 6 and FIG. 7, differences between a rotary dripping aromatherapy humidifier 2 according to a second embodiment of the present disclosure and a rotary dripping aromatherapy humidifier according to a first embodiment of the present disclosure are as follows:

The second embodiment does not have a bearing structure, but rotatable connection is performed directly by using a rotating contact surface;

a first running fit surface 251 is disposed around the inner side of the gear sleeve connector 25; a second running fit surface corresponding to the first running fit surface 251 is disposed on the outer side of the rotating column 241 or the rotating boss; and the gear sleeve connector 25 and the rotating column 241 or the rotating boss are rotatably connected by using the first running fit surface 251 and the second running fit surface.

Technical effects generated for solving the technical problem according to the present disclosure are as follows:

Compared with the prior art, a rotary dripping aromatherapy humidifier 1 in the present disclosure is provided with a humidifier host body, a water storage cover 19 located on an upper part of the humidifier host body, and a support guide tube 17 configured to support the water storage cover 19 at the same time. The control circuit board 111 and the atomization assembly 12 are disposed inside the humidifier host body. The rotary dripping aromatherapy humidifier further includes dripping holes 194 provided on the water storage cover 19. The support guide tube 17 is of an internally hollow structure, and the atomization assembly 12 is located at the bottom of the support guide tube 17. Fog and mist generated by the atomization assembly 12 get into the water storage cover 19 after passing through the support guide tube 17, and drip downwards from the part of the dripping holes 194. The water storage tank 14 configured to store water is disposed in the humidifier host body. The water dripping from the dripping holes 194 flows into the water storage tank 14. The bottom of the support guide tube 17 stretches into the inner side of the humidifier host body. The rotary dripping aromatherapy humidifier further includes a drive motor 13 configured to drive the support guide tube 17 to rotate axially. An output shaft of the drive motor 13 is in drive movable connection with a lower part of the support guide tube 17, so as to drive the support guide tube 17 to rotate axially together with the water storage cover 19. During actual use, the drive motor 13 can drive the support guide tube 17 and the water storage cover 19 to rotate axially integrally, and effects such as water dripping, lamplight, and mist spraying are combined, thereby greatly improving using ornamental degree and experience degree in use and saving costs.

The foregoing descriptions are implementations of the present disclosure, but are not intended to limit the protection scope of the present disclosure. Any modification, equivalent replacement, or improvement made without departing from the spirit and principle of the present disclosure shall fall within the protection scope of claims of the present disclosure.

What is claimed is:

1. A rotary dripping aromatherapy humidifier, comprising a humidifier host body, a water storage cover located at an upper part of the humidifier host body, and a support guide tube configured to support the water storage cover; a control circuit board and an atomization assembly being disposed inside the humidifier host body; further comprising dripping holes provided on the water storage cover, wherein the support guide tube is of an internally hollow structure, and the atomization assembly is located at the bottom of the support guide tube; fog and mist generated by the atomization assembly get into the water storage cover after passing through the support guide tube, and drip downwards from the part of the dripping holes;

a water storage tank configured to store water is disposed in the humidifier host body;

water dripping from the dripping holes flows into the water storage tank;

the bottom of the support guide tube stretches into an inner side of the humidifier host body; the rotary dripping aromatherapy humidifier further includes a drive motor configured to drive the support guide tube to rotate axially; an output shaft of the drive motor is in drive movable connection with a lower part of the support guide tube, so as to drive the support guide tube to rotate axially together with the water storage cover; and the atomization assembly and the drive motor are electrically connected to the control circuit board.

2. The rotary dripping aromatherapy humidifier according to claim 1, wherein a gear sleeve connector in matched connection with the bottom of the support guide tube is further disposed in the humidifier host body; a drive gear is disposed on an outer edge of the gear sleeve connector;

the output shaft of the drive motor is connected to a driving gear; the drive motor and the gear sleeve connector are gear-driven; and a rotating column, a rotating boss, or a rotating slot configured to limit the gear sleeve connector is further disposed on the inner side of the humidifier host body.

3. The rotary dripping aromatherapy humidifier according to claim 2, wherein at least one rolling bearing is further disposed on the inner side of the gear sleeve connector; the rolling bearing is located at a part between the gear sleeve connector and the rotating column or the rotating boss; and a bearing stopper configured to define a position of the rolling bearing is disposed on the inner side of the gear sleeve connector.

4. The rotary dripping aromatherapy humidifier according to claim 2, wherein a first running fit surface is disposed around the inner side of the gear sleeve connector; a second running fit surface corresponding to the first running fit surface is disposed on the outer side of the rotating column or the rotating boss; and the gear sleeve connector and the rotating column or the rotating boss are rotatably connected by using the first running fit surface and the second running fit surface.

5. The rotary dripping aromatherapy humidifier according to claim 1, wherein at least one water tray to play water storage, dripping, and decoration functions is further disposed on the support guide tube;

water tray water storage slots corresponding to the dripping holes are provided on the water tray; water tray dripping holes are provided in the water tray water storage slot; and water from the dripping holes drips into the water tray water storage slots, and drips into the water storage tank by using the water tray dripping holes.

6. The rotary dripping aromatherapy humidifier according to claim 1, wherein the humidifier host body comprises an outer housing;

the water storage tank is located at an upper part of the outer housing;

the control circuit board, the atomization assembly, and the drive motor are located in internal space between the bottom of the water storage tank and the outer housing; and an upper end of the output shaft of the drive motor stretches into the bottom of the water storage tank.

7. The rotary dripping aromatherapy humidifier according to claim 1, wherein the water storage cover comprises a water storage box configured to store water and a top cover in matched connection with an upper part of the water storage box; the dripping holes are provided in the water storage box;

the top of the support guide tube is in matched connection with the water storage box, so as to input fog and mist into the water storage cover; and the rotary dripping aromatherapy humidifier further includes spray holes provided on the top cover.

8. The rotary dripping aromatherapy humidifier according to claim 2, wherein an atomization concentrating cylinder configured to increase a water spray height of the atomization assembly is further disposed on the inner side of the rotating column or the rotating boss;

the atomization concentrating cylinder and the inner side of the humidifier host body are connected or integrally formed;

the atomization concentrating cylinder is located at an upper part of the atomization assembly; and a water inlet hole for supplying water to the part of the atomization concentrating cylinder is provided on the rotating column or the rotating boss.

9. The rotary dripping aromatherapy humidifier according to claim 1, wherein an air inlet hole is further provided on the support guide tube, so as to facilitate air to enter into the inner side of the support guide tube.

10. The rotary dripping aromatherapy humidifier according to claim 1, wherein LED (Light-Emitting Diode) light beads are further disposed inside the humidifier host body, so as to produce a lighting effect.

* * * * *